US007228665B2

(12) United States Patent
Perry

(10) Patent No.: US 7,228,665 B2
(45) Date of Patent: Jun. 12, 2007

(54) ROOF AND WALL COVERING WITH IMPROVED CORNER CONSTRUCTION

(75) Inventor: John Perry, Dania Beach, FL (US)

(73) Assignee: Nailite International, Inc., Miami, FL (US)

( * ) Notice: Subject to any disclaimer, the term of this patent is extended or adjusted under 35 U.S.C. 154(b) by 168 days.

(21) Appl. No.: 10/912,707

(22) Filed: Aug. 5, 2004

(65) Prior Publication Data

US 2006/0059830 A1 Mar. 23, 2006

(51) Int. Cl.
*E04F 13/00* (2006.01)
*E04F 13/06* (2006.01)

(52) U.S. Cl. ..... 52/287.1; 52/288.1; 52/716.1; 52/716.8; 52/314; 52/409; 52/546; 52/544; 52/547

(58) Field of Classification Search ..... 52/287.1, 52/288.1, 276, 535–560, 57, 518–532, 716.1, 52/716.8, 282.1, 282.4, 582.1, 731.7, 731.8, 52/712, 314, 409; D25/55, 119, 126, 136, D25/164; 403/403, 382, 286, 293
See application file for complete search history.

(56) References Cited

U.S. PATENT DOCUMENTS 2,607,449 A * 8/1952 Daniels ..... 52/553
2,616,131 A * 11/1952 Gage ..... 52/576
2,849,757 A * 9/1958 Meldrum ..... 52/276
2,949,757 A * 8/1960 Page ..... 66/146
3,304,676 A 2/1967 Sallie et al.
3,651,610 A * 3/1972 Donahue ..... 52/278
3,828,499 A * 8/1974 Leddy ..... 52/278
5,347,784 A 9/1994 Crick et al.
5,836,123 A * 11/1998 Gulino ..... 52/288.1
6,341,458 B1 * 1/2002 Burt ..... 52/287.1
6,684,587 B2 * 2/2004 Shaw et al. ..... 52/288.1
2003/0226327 A1 * 12/2003 Perry ..... 52/287.1
2005/0262784 A1 * 12/2005 Justice ..... 52/287.1

* cited by examiner

*Primary Examiner*—Jeanette Chapman
(74) *Attorney, Agent, or Firm*—Leydig, Voit & Mayer, Ltd

(57) ABSTRACT

A wall covering for a pair of wall surfaces that form a corner. The wall covering includes (1) plurality of wall panels each having a plurality of horizontal tiers of simulated building elements and (2) a plurality of corner moldings each having a single tier of building elements. The corner moldings each have mounting flanges and an interlock and alignment pin that facilitate adjustable positioning of the corner molding with a selected tier of building elements of an adjacent wall panel. The corner molding mounting flanges and building elements further define relatively deep wall panel receiving pockets for positively retaining the side of an adjacent wall panel and forming a water barrier.

27 Claims, 4 Drawing Sheets

ROOF AND WALL COVERING WITH IMPROVED CORNER CONSTRUCTION

FIELD OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

BACKGROUND OF THE INVENTION

Various synthetic roof and wall coverings are known today, such as those formed of elongated thermoplastic wall panels that are nailed or screwed to a wall or roof support surface in horizontal courses or rows in partially overlapping relation to each other so as to provide a substantially water resistant, protective layer over the support surface. Such panels, which usually are identically molded, commonly are formed with a plurality of rows of simulated building elements, such as shake shingles. Since the panels are identically molded, a panel-to-panel identity can be easily noticed if the panels are not carefully installed. Installation problems particularly occur when installing such synthetic wall and roof coverings about a corner of the roof or sidewalls, and particularly, on Mansard style roofs.

Mansard style roofs, which are especially common in commercial buildings, comprise slanted roof sections that extend between an overhang and a flat upper roof section. Because the angle of the slanted roof sections can vary significantly, the length of the line of intersection between the two slanted roof sections along a corner can vary significantly, with more vertically oriented roof sections having a smaller line of intersection than more slanted roof sections.

It is common to join such slanted roof sections with a corner molding which has a plurality of tiers simulated building elements corresponding to the tiers of the wall panels. Because the length line of intersection between the slanted roof sections vary significantly depending upon the angle of the roof section heretofore, it has been difficult to conceal the panel to panel identity of the assembled roof if the wall panels and the corner panels are not carefully installed or altered for the particular installation. This can be a tedious and time consuming procedure. Furthermore, leakage between adjoining corner moldings and wall panels can occur if the ends of the wall panels are not carefully cut and assembled onto the corner moldings

OBJECTS AND SUMMARY OF THE INVENTION

It is an object of the present invention to provide a wall covering having corner moldings that facilitate efficient and reliable installation of the wall covering about the corners of roofs and sidewalls Another object is to provide a wall covering as characterized above that is adapted for efficient installation on Mansard roofs without detracting from the aesthetic appearance of the roof.

A further object is to provide a corner molding, of the foregoing type that facilitates faster installation of the wall covering on Mansard roofs.

Yet another object is to provide a corner molding of the above kind that enables positive interlocking of the corner molding with both horizontally adjacent wall panels and vertically adjacent corner moldings. A related object is to provide a wall covering with a corner construction that which more effectively prevents separation and leakage during severe weather conditions.

Other objects and advantages of the invention will become apparent upon reading the following detailed description and upon reference to the drawings, in which:

Figure 1:
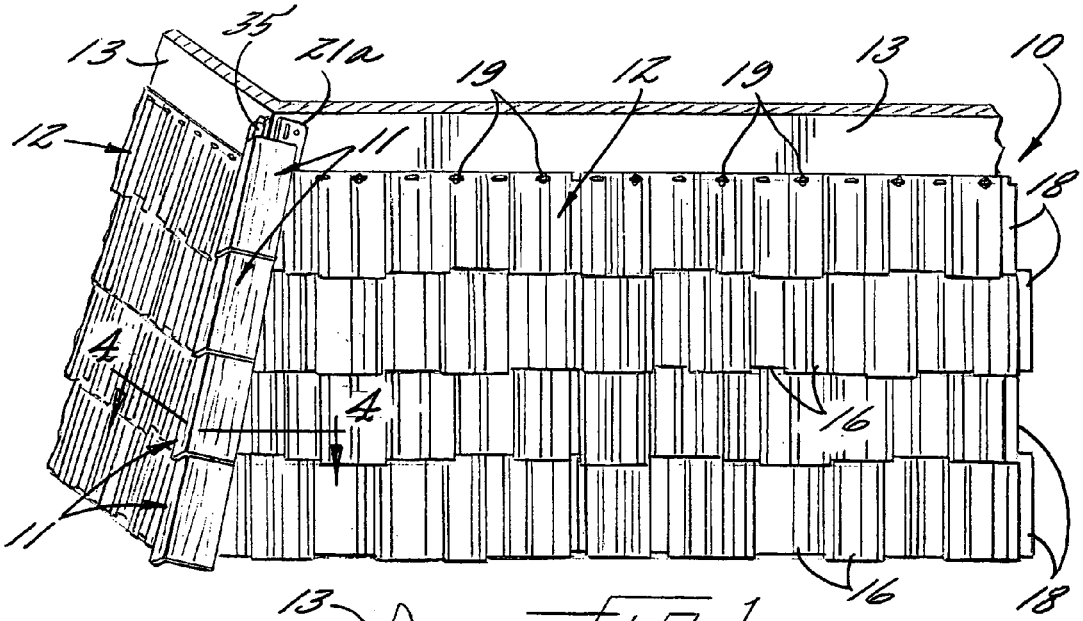
FIG. 1 is a perspective of a wall covering having corner construction in accordance with the invention.
Figure 2:
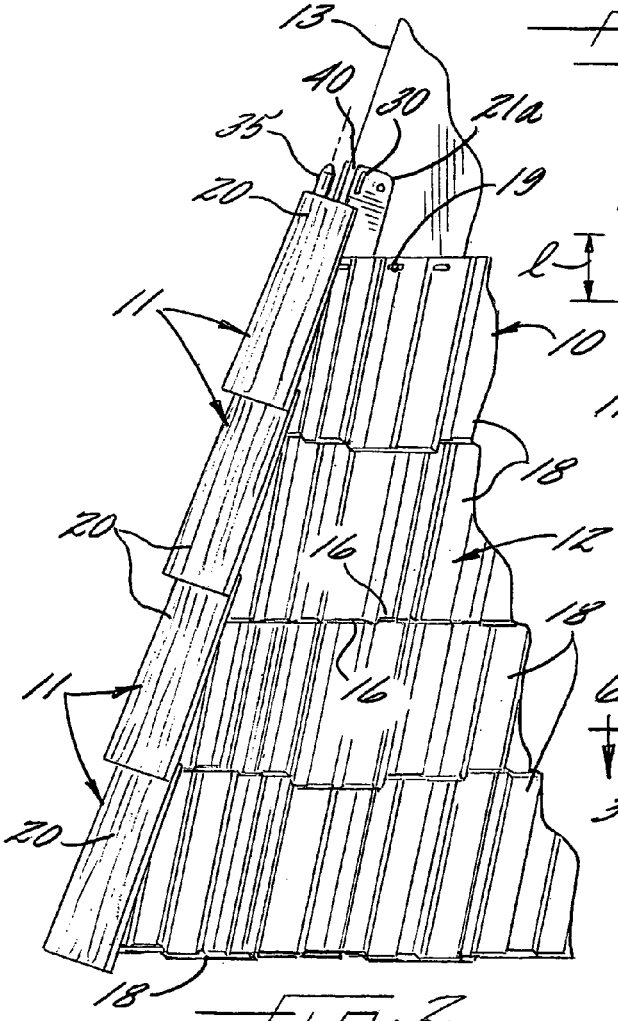
FIG. 2 is an enlarged side elevational view of the corner construction of the wall covering shown in FIG. 1.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBOIDMENT

Referring now more particularly to the drawings, there is shown an illustrative wall covering 10 mounted about a corner of roof or sidewall surfaces 13 of a building structure, such as the slanted wall sections of a Mansard style roof. The wall covering 10 comprises a plurality of corner moldings 11 mounted in vertically or longitudinally stacked relation to each other and a plurality of wall panels 12 mounted laterally of the corner moldings 11.

The panels 12 may be of a known type, such as shown in application Ser. No. 10/144,284 filed May 10, 2002, assigned to the same assignee as the present application, the disclosure of which is incorporated herein by reference. The panels 12, which preferably are molded out of relatively thin rigid plastic material, each are formed with simulated building elements 16. In this instance, the panels 12 are formed with building elements in the form simulated cedar shake 16 of irregular width, which are disposed in a plurality of parallel horizontal rows tiers 18. It will be understood that the panels 12 could be formed with other forms of simulated shake shingles, or other types of building elements, such as tile, brick and the like.

As is known in the art, the wall panels 12 are mounted on support surfaces 13 of the building wall or roof structure in horizontal courses with the right-side marginal edge region in underlying relation to the left-side marginal edge region of the panel 12 immediately to the right thereof and with the lower marginal edge region of the panels 12 in each course overlying the upper marginal edge region of the panel in the course immediately below. To enable side-by-side installation of the panels 12 with the junctures between panels less noticeable to the eye, the rows 18 of shake 16 of each panel 12 extend in lateral offset relation to each other so as to define stepped left and right-hand sides of the panel. As also known in the art, the stepped end of a panel 12 mounted adjacent a corner molding 11 is cut square with the corner molding 12 at the time of installation.

For securing the panels 12 to the support surfaces 21, the upper marginal edge region of each panel 12 is formed with a row of elongated laterally spaced fastener receiving apertures 19. It will be understood that the right side marginal edge regions of each panel also may be formed with fastener receiving apertures and that appropriate interlocking means may be provided between overlapping upper and lower marginal edge regions, as well as between overlapping side marginal edge regions.

In accordance with the invention, the corner moldings each are formed with a single tier of simulated building elements and are selectively positionable in inter-engaging relation with each other to compensate for alignment differences in the tiers of building elements on the wall panels due to the angle of intersection of the roof or wall surfaces that define the corner, such as particularly occurs in Mansard style roofs. To this end, the illustrated corner moldings 11 each are formed with a single tier of simulated building elements in the form of a pair of shake building elements 20 disposed at an angle to each other corresponding substantially to the angle of the wall surfaces 13 upon which the corner molding 11 is mountable. The building elements 20 each have an outer surface extending in downwardly and outwardly tapered fashion, similar to the shake in the corresponding rows 18 of the wall panels 12. It will be understood that, like the wall panels 12, the corner moldings 11 may be made of molded thermoplastic material.

For supporting the corner moldings on the wall surfaces 13, each corner molding has a pair of mounting flanges 21 disposed inwardly spaced generally parallel relation to building elements 20. The mounting flanges 21 extend laterally a greater distance than the building elements and are formed with a plurality of fastener receiving apertures 24 for easy access during installation. The mounting flanges 21 in this case are supported by a pair of parallel longitudinal flanges 22 that extend inwardly from internal sides of the building elements 20 in parallel relation to each other and to the line of intersection of the wall surfaces 13 that define the corner. Upper and lower transverse flanges 25, 26, respectively, also connect between the mounting flanges 22 and internal adjoining sides of the building elements 20.

Figure 4:
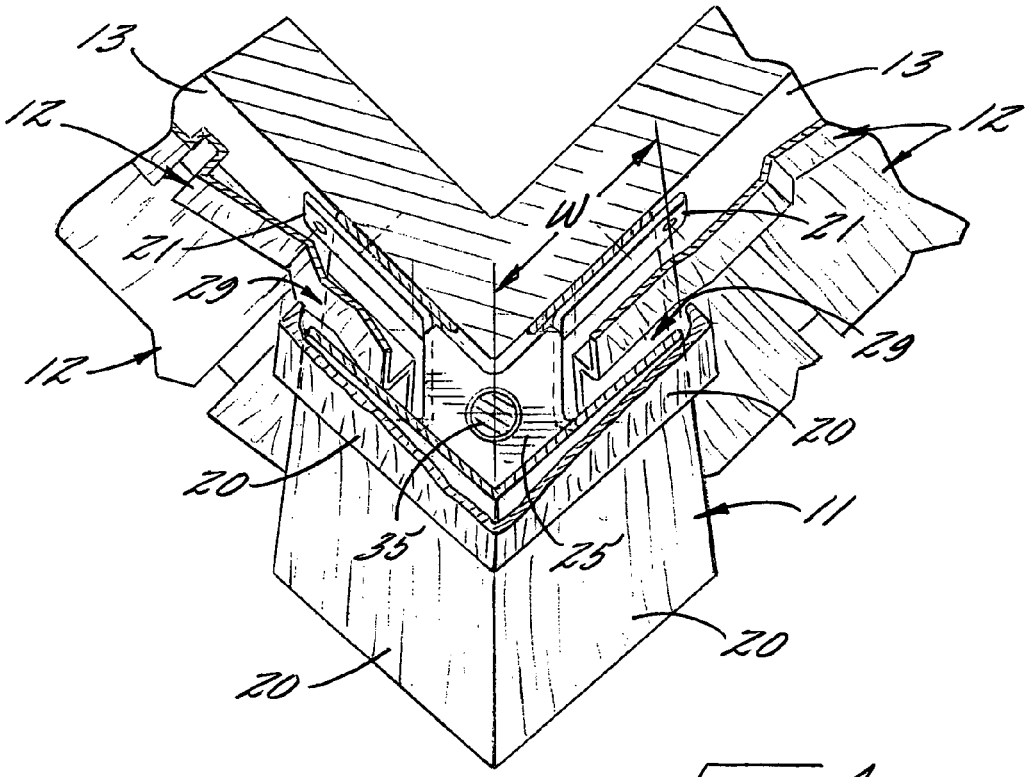
FIG. 4 is an enlarged fragmentary section of the corner of the illustrated wall covering, taken in the plane of line 4—4 in FIG. 1.
Figure 5:
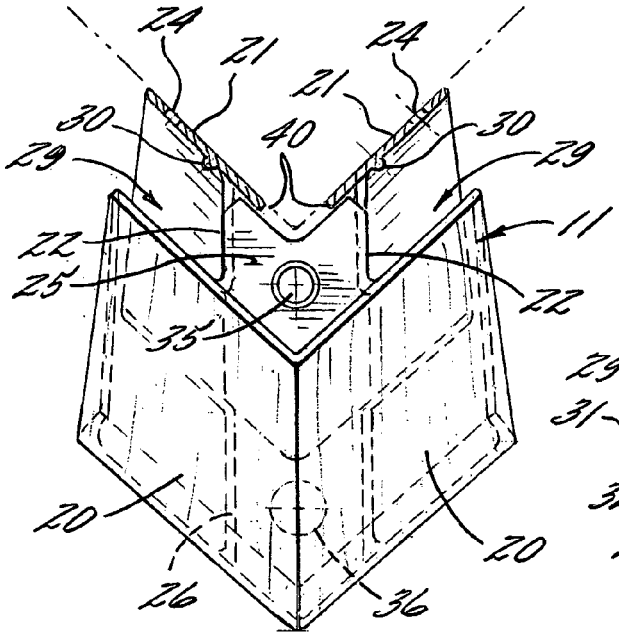
FIGS. 5 and 6 are enlarged fragmentary sections of one of the illustrated corner moldings, taken in the plane of lines 5—5 and 6—6 respectively in FIG. 3.
Figure 6:
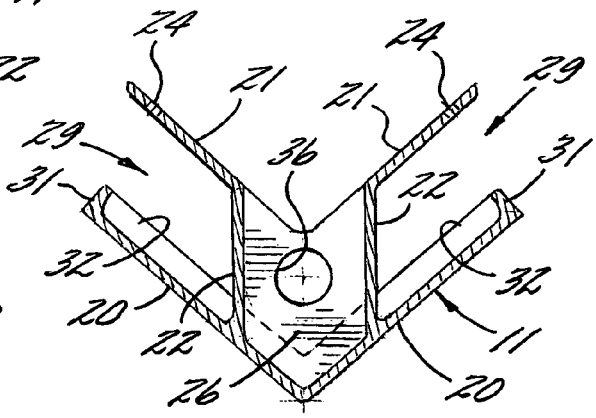
Figure 7:
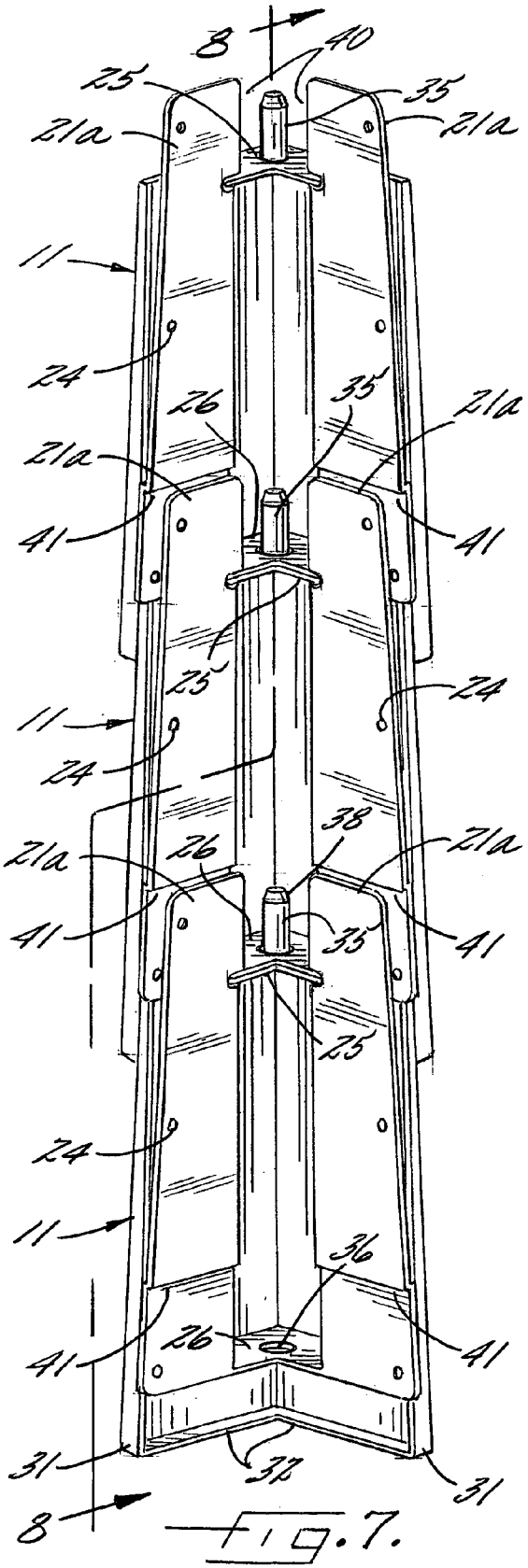
FIG. 7 is an underside view of a plurality of corner moldings of the illustrated wall covering shown in assembled relation to each.
Figure 8:
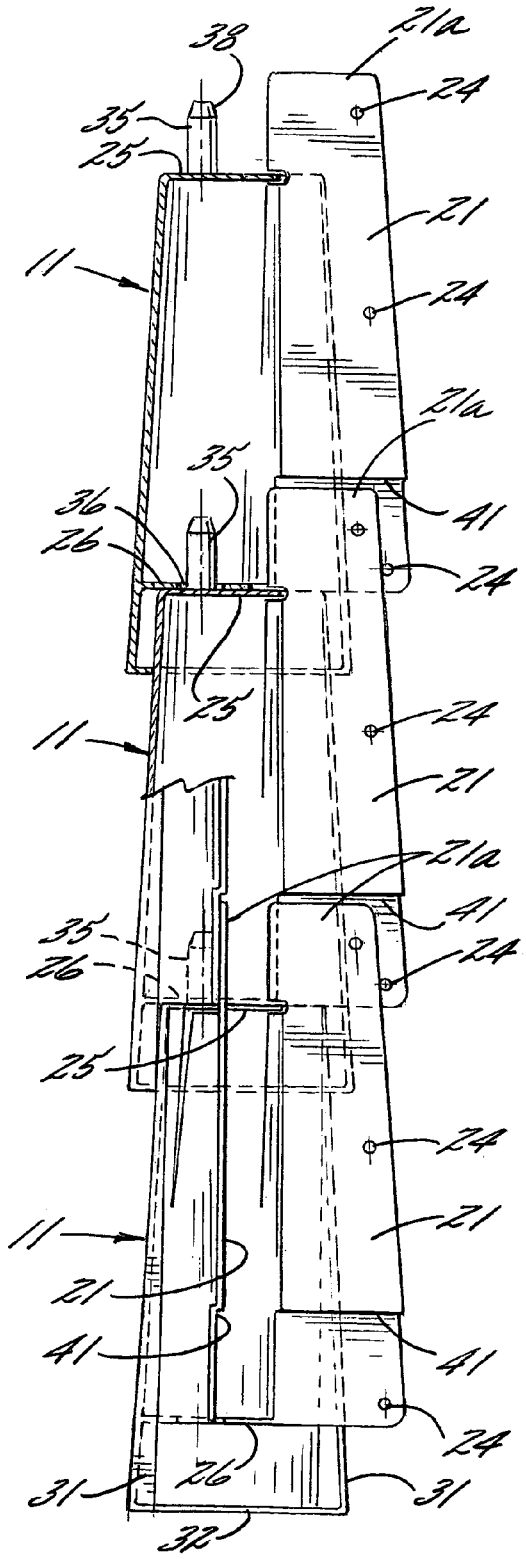
FIG. 8 is a fragmentary section of the assembled corner moldings shown in FIG. 7, taken in the plane of line 8—8.
Figure 9:
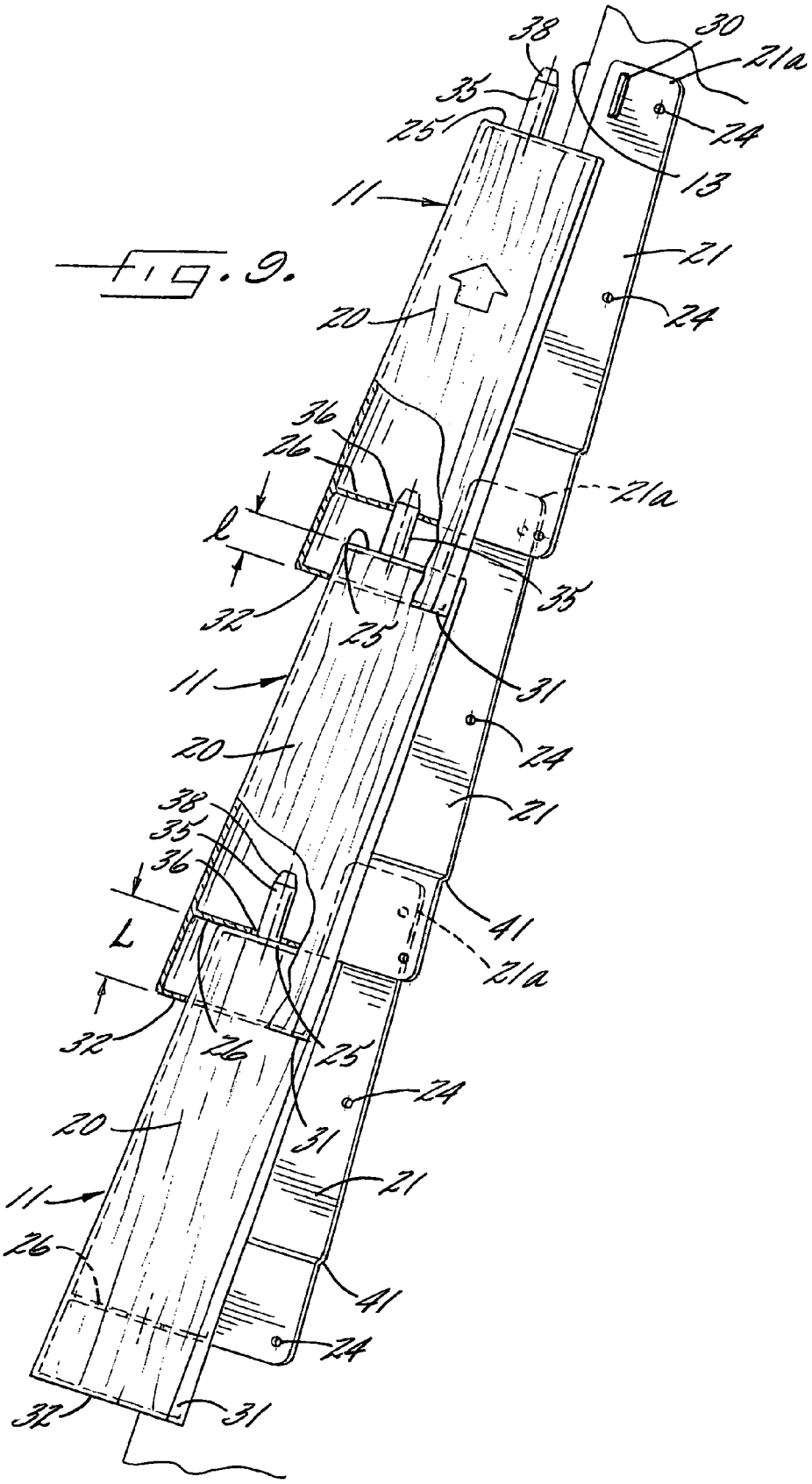
FIG. 9 is a side elevational view of the assembled corner moldings shown in FIG. 7, in partial section.

In carrying out the invention, the mounting flanges 21 and building elements 20 define relatively deep panel receiving pockets or recesses 29 on opposite sides thereof for ascetically receiving and positively retaining respective ends of adjacently mounted wall panels 12 in a manner than also defines an effective water barrier therebetween. The panel receiving pockets 29 in this case extend at least about one-third the transverse width w of the corner molding, as depicted in FIG. 4. It will be appreciated that an installer may randomly cut a side of the wall panel 12 that begins the course, without precision, and easily and quickly position the cut end into the panel receiver pocket 29. To facilitate locating a side end of the wall panel 12 in the pocket 29, an upstanding abutment rib 30 (FIGS. 3 and 5) is provided on each mounting flange 21 within the pocket 29 against which the panel may be positioned. It can be seen that the pocket 29 not only receives and positively retains the end of the panel 12 in the corner molding 11, the assembly provides a relatively long circuitous water barrier path for water that may be forced into the pocket during severe weather conditions. To further enclose the juncture of the corner moldings 11 and the adjoining side wall panels 12, the peripheral side and bottom edges of the corner molding building elements each are formed with an inwardly directed flanges 31, 32 respectively (FIG. 6).

In accordance with an important aspect of the invention, the corner moldings 11 further are adapted for positive interlocking engagement with each other for further preventing separation, while permitting easy aligned positioning of the corner molding building elements 20 with a selected tier 18 of building elements 16 of an adjacent wall panel 12. To this end, each corner molding 11 has a longitudinally extending interlock and alignment pin 35 that is positionable within an interlock and alignment aperture 36 of a vertically adjacent corner molding 11. In this case, the interlock and alignment pin 35 is mounted in upstanding relation on the upper transverse flange 25 of the corner molding and the lower transverse flange 26 of each corner element is formed with the aperture 36 for receiving the interlock and alignment pin 35 of an underlying corner molding 11 during installation. To facilitate positioning of the interlocking alignment pin 35 into a respective aperture 36, the upper end of each pin 35 is formed with a taper 38.

Figure 3:
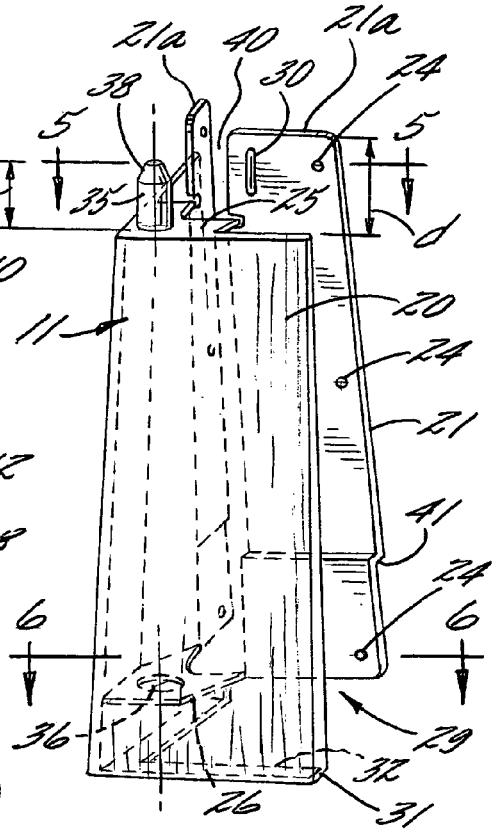
FIG. 3 is an enlarged perspective of one of the corner moldings of the illustrative wall covering.

In carrying out the invention, the mounting flanges 21 of each corner molding 11 have an extended portion 21*a* that protrudes upwardly longitudinal a significant distance d above the upper perimeter of the corner molding building elements 20 and the building elements 20 each have an extended portion that extends a distance downwardly beyond a lower perimeter of the mounting flanges 21 (FIG. 3). In this case, the mounting flanges 21 extend a distance d above the building elements 20, greater than the distance l the interlock and alignment pin 35 protrudes above the upper perimeter of the building elements 20, and the building elements 20 extend a corresponding distance greater than the protruding distance l of the interlocking alignment pin 35 beyond the lower perimeters of the mounting flanges 21. The upper extended portions 21*a* of the mounting flanges 21 in this instance each are formed with one of the fastener receiving apertures 24 for easy access during mounting. The extended mounting flange portions 21*a* also are formed with the alignment ribs 30 for enabling the installer to easily observe the intended position of the adjacent wall panel 12 during installation. The upper extended portions 21*a* of the mounting flanges 21 in this case are separated to define a slot or opening 40 there between for permitting breathing of moisture laden air that might exist between the mounted corner molding 11 and wall surfaces 13.

The lower ends of the mounting flanges 21 in this case are bent upwardly to define a recess 41 that facilitates overlapping mounting of the mounting flanges 21 of one corner molding onto the upper extended portions 21*a* of the mounting flanges 21 of the underlying corner molding 11. During installation of the wall covering, it will be understood by one skilled in the art that the corner moldings 11 may be mounted on the corner of the wall or roof structure in overlying relation to each other, as depicted in FIGS. 7–10, dependent upon the angle of the roof or wall surfaces that define the corner. The corner moldings 11 are easily positionable for aligned relationship with a selected tier of building elements 16 of a laterally adjacent wall panel 12 and into inter-engaging relation with an underlining corner molding 11, with the pin receiving aperture 36 of the corner molding 11 being positionable over the interlock and alignment pin 35 of the underlying corner molding 11. Interlocking engagement of the pin receiving aperture 36 with the interlocking alignment pin 35 of the underlying corner molding 11 further ensures overlapping positioning of the building elements 20 of the corner molding 11 with the building elements 20 of the underlying corner molding 11. Moreover, with the corner moldings 11 in interlocked relation both with each other and the adjacent laterally positioned wall panels 12, a secure corner structure is created that resists separation during severe weather conditions and more effectively prevents water leakage.

From the foregoing, it can be seen that a wall covering is provided that facilitates efficient and reliable installation of corner moldings and wall panels about corner structures of buildings, regardless of the angle of the line of intersection of the wall surfaces. The corner moldings of the invention facilitate faster insulation of the wall covering and provide positive interlocking engagement both with adjacent corner moldings and wall panels for more effectively preventing separation and leakage during severe weather conditions. Yet the corner moldings are relatively simple in construction and lend themselves to economical manufacture and plastic injection molding.

What is claimed is:

1. A one piece corner molding for a wall covering mountable on two wall surfaces that form a corner having a longitudinally-extending apex and which includes a plurality of laterally adjacent wall panels each formed with a plurality of horizontal tiers of simulated building elements, said corner molding comprising a single tier of building elements having a pair of building elements disposed at an angle to each other corresponding substantially to the angle of the wall surfaces that define a corner upon which the corner molding is mountable, a pair of mounting flanges disposed at an angle to each other in underlying relation to the pair of simulated building elements for adjustable positioning in a longitudinal direction parallel to the apex of the corner defined by the wall surfaces and relative to a previously-mounted identical corner molding, said corner molding simulated building elements each having a lower peripheral portion positionable in overlying relation to the building elements of a previously-mounted corner molding, a longitudinally-extending interlock pin on an underside of the corner molding and adjacent one longitudinal end of the simulated building elements of the corner molding, said corner molding being formed with an interlock pin receiving aperture on an underside of the corner molding and adjacent an opposite longitudinal end of the corner molding for engagement by an interlock pin of an identical longitudinally-adjacent corner molding of the wall covering, and said pin receiving aperture being disposed a greater difference from its adjacent longitudinal end of the corner molding than the longitudinal length of said interlock pin such that the interlock pin can be adjustably positioned within the pin receiving aperture of a longitudinally-adjacent corner molding along the length of the pin while the lower peripheral portion of the building elements of the corner molding remain in overlying relation to the building elements of a previously-mounted corner molding.

2. The corner molding of claim 1 in which said building element extended portions extend longitudinally beyond the mounting flanges a distance greater than the distance said interlock pin extends longitudinally beyond the building elements.

3. The corner molding of claim 1 in which said corner molding building elements and mounting flanges define a pair of longitudinally extending laterally opening recesses each for receiving and positively retaining a side end of a laterally adjacent wall panel.

4. The corner molding of claim 3 in which said recesses each extend laterally beneath the respective building element a distance corresponding to at least one-third the lateral width of the corner molding.

5. The corner molding of claim 1 in which said interlock pin has a tapered terminal end portion.

6. The corner molding of claim 1 in which said mounting flanges extend from a pair of longitudinal flanges extending inwardly from an underside of the building elements.

7. The corner molding of claim 1 in which said mounting flanges have a longitudinally-extended portion at one end that extends longitudinally beyond one longitudinal end of the simulated building elements of the corner molding, and said peripheral portions of the simulated building elements of the corner molding extend beyond an opposite longitudinal end of the mounting flanges.

8. The corner molding of claim 7 in which said extended flange portions and interlock pin extend beyond a common longitudinal end of the corner molding and, said extended flange portions extend a greater longitudinal distance beyond the corner molding building elements than said interlock pin.

9. The corner molding of claim 7 in which said interlock pin and extended mounting flange portions are disposed at a common longitudinal end of the corner molding.

10. The corner molding of claim 9 in which said interlock pin and extended mounting flange portions are disposed adjacent an upper end of the corner molding and said pin receiving aperture is disposed adjacent a lower end of the corner molding.

11. A corner molding for a wall covering mountable on two wall surfaces that form a corner and which includes a plurality of laterally adjacent wall panels each formed with a plurality of horizontal tiers of simulated building elements, said corner molding comprising a single tier of building elements having a pair of building elements disposed at an angle to each other corresponding substantially to the angle of the wall surfaces that define a corner upon which the corner molding is mountable, a pair of mounting flanges disposed at an angle to each other in underlying relation to the pair of simulated building elements and extending substantially the longitudinal length of the building elements for mounting on the wall surfaces, at least one longitudinal support flange disposed between said building elements and mounting flange and extending substantially the longitudinal length of the said building elements, said corner molding building elements, at least one longitudinal support flange, and mounting flanges defining a pair of laterally-opening pockets substantially closed on three longitudinal sides by said building elements, at least one longitudinal support flange, and mounting flanges each for receiving and positively retaining an end of a laterally adjacent wall panel, at least one longitudinally extending interlock pin disposed in underlying relation to the building elements of the corner molding, and said corner molding being formed with an interlock pin receiving aperture for receiving the interlock pin of a longitudinally adjacent corner molding for permitting interlocking adjustable positioning of the corner molding on the wall surfaces relative to a longitudinally adjacent corner molding and a selected tier of building elements of a laterally adjacent wall panel.

12. The corner molding of claim 11 in which said pockets each extend laterally beneath the respective building element a distance corresponding to at least one-third the lateral width of the corner molding.

13. The corner molding of claim 11 in which said interlock pin is disposed at an upper end of the corner molding and said pin receiving aperture is disposed adjacent a lower end of the corner molding.

14. The corner molding of claim 12 including transverse flanges extending between said building elements and mounting panels adjacent opposite ends of the corner molding, said interlock pin extending outwardly from one of said transverse flanges and the other of said transverse flanges being formed with said interlock pin receiving aperture.

15. A wall covering for a pair of wall surfaces that form a corner having a longitudinally-extending apex comprising a plurality of wall panels each having a plurality of horizontal tiers of simulated building elements, said wall panels being mounted in partially overlapping relation to each other to cover the wall surface, a plurality of corner moldings for laterally joining the wall panels at the corner, said corner molding comprising a single tier of building elements having a pair of building elements disposed at an angle to each other corresponding substantially to the angle of the wall surfaces that define a corner upon which the corner molding is mountable, said corner moldings each having a pair of mounting flanges disposed at an angle to each other in underlying relation to the pair of simulated building elements for adjustable positioning in a longitudinal direction parallel to the apex of the corner defined by the wall surfaces and relative to a previously-mounted corner molding of the wall covering, said corner molding simulated building elements each having a lower peripheral portion positionable in overlying relation to the building elements of an underlying previously-mounted corner molding, said corner moldings each having a longitudinally-extending interlock pin on an underside and adjacent one longitudinal end of the simulated building element of the corner molding, said corner molding each being formed with an interlock pin receiving aperture on an underside of the corner molding and adjacent an opposite longitudinal end of the corner molding for engagement by the interlock pin of a longitudinally-adjacent corner molding of the wall covering, and said interlock pin of one corner molding being adjustably positionable within the pin receiving aperture of a longitudinally adjacent corner molding along its longitudinal length for permitting interlocking adjustable positioning of the corner molding on the wall surfaces relative to a longitudinally-adjacent corner molding and into aligned relation to a selected tier of building elements of a laterally adjacent wall panel while the lower peripheral portions of the building elements of the corner molding remain in overlying relation to the building elements of a previously-mounted corner molding.

16. The wall covering of claim 15 in which said corner molding building elements and mounting flanges of each corner molding define a pair of longitudinally extending laterally opening recesses each for receiving and positively retaining a side end of a laterally adjacent wall panel.

17. The wall covering of claim 15 in which the mounting flanges of each corner molding have a longitudinally-extended portion at one end that extends beyond one longitudinal end of the simulated building elements of the corner molding, and the peripheral portions of the simulated building elements of the corner molding extend beyond an opposite lateral end of the mounting flanges.

18. The wall covering of claim 17 in which said extended portions of the mounting flanges of each corner molding are disposed in underlying relation to the mounting flange of a longitudinally adjacent corner molding.

19. The wall covering of claim 17 in which said extended flange portions of each corner molding extend a greater longitudinal distance beyond the corner molding building elements than said interlock pin.

20. The wall covering of claim 17 in which said interlock pin and extended mounting flange portions of each corner molding are disposed at a common longitudinal end of the corner molding.

21. The wall covering of claim 17 in which said mounting flange extended portions of each corner molding have a locating rib protruding into the panel receiving recess for locating the side end of a wall panel in predetermined position within the recess.

22. A wall covering for a pair of wall surfaces that form a corner comprising a plurality of wall panels each having a plurality of horizontal tiers of simulated building elements, said wall panels being mounted in partially overlapping relation to each other to cover the wall surface, a plurality of corner moldings for laterally joining the wall panels at the corner, said corner molding each comprising a single tier of building elements having a pair of building elements disposed at an angle to each other corresponding substantially to the angle of the wall surfaces that define a corner upon which the corner molding is mountable, said corner moldings each having a pair of mounting flanges disposed at an angle to each other in underlying relation to the pair of simulated building elements and extending substantially the longitudinal length of the building elements for mounting on the wall surfaces, said corner molding each having at least one longitudinal support flange disposed between said building elements and mounting flanges and extending substantially the longitudinal length of the said building elements, said corner molding building elements, at least one longitudinal support flange, and mounting flanges of each corner molding defining a pair of laterally-opening pockets substantially closed on three longitudinal sides by said building elements, at least one longitudinal support flange, and mounting flanges for receiving and positively retaining a side end of a laterally adjacent wall panel, said corner moldings each having at least one interlock pin extending beyond one longitudinal end of the simulated building elements of the corner molding, and said corner moldings each being formed with an interlock pin receiving aperture for receiving the interlock pin of a longitudinally adjacent corner molding for permitting interlocking adjustable positioning of the corner molding on the wall surfaces relative to an adjacent corner molding and into aligned relation to a selected tier of building elements of a laterally adjacent wall panel.

23. The wall covering of claim 22 in which said pockets of each corner molding extend laterally beneath a respective building element a distance corresponding to at least one-third the lateral width of the corner molding.

24. The wall covering of claim 22 in which said interlock pin of each corner molding is disposed at an upper end of the corner molding and said pin receiving aperture is disposed adjacent a lower end of the corner molding.

25. A corner molding for a wall covering mountable on two wall surfaces that form a corner and which includes a plurality of laterally adjacent wall panels each formed with a plurality of horizontal tiers of simulated building elements, said corner molding comprising a single tier of building elements having a pair of building elements disposed at an angle to each other corresponding substantially to the angle of the wall surfaces that define a corner upon which the corner molding is mountable, a pair of mounting flanges disposed at an angle to each other in underlying relation to the pair of simulated building elements for mounting on the wall surfaces and for defining with the building elements panel receiving recesses each for a side of a respective wall panel, said mounting flanges each having locating rib protruding into the panel receiving recess for locating the side of a wall panel in predetermined position within the recess, said mounting flanges each having a longitudinally extended portion at one end that extends beyond one longitudinal end of the simulated building elements of the corner molding, said corner molding simulated building elements each having an extended portion that extends beyond an opposite longitudinal end of said mounting flanges, at least one interlock pin extending beyond one longitudinal end of the simulated building elements of the corner molding, and said corner molding being formed with an interlock pin receiving aperture for receiving the interlock pin of a longitudinally adjacent corner molding for permitting interlocking adjustable positioning of the corner molding on the wall surfaces relative to a longitudinally adjacent corner molding and a selected tier of building elements of a laterally adjacent wall panel.

26. A corner molding for a wall covering mountable on two wall surfaces that form a corner and which includes a plurality of laterally adjacent wall panels each formed with a plurality of horizontal tiers of simulated building elements, said corner molding comprising a single tier of building elements having a pair of building elements disposed at an angle to each other corresponding substantially to the angle of the wall surfaces that define a corner upon which the corner molding is mountable, a pair of mounting flanges disposed at an angle to each other in underlying relation to the pair of simulated building elements for mounting on the wall surfaces, said mounting flanges each having a longitudinally extended portion at one end that extends beyond one longitudinal end of the simulated building elements of the corner molding, said corner molding simulated building elements each having an extended portion that extends beyond an opposite longitudinal end of said mounting flanges, at least one interlock pin extending beyond one longitudinal end of the simulated building elements of the corner molding, said corner molding being formed with an interlock pin receiving aperture for receiving the interlock pin of a longitudinally adjacent corner molding for permitting interlocking adjustable positioning of the corner molding on the wall surfaces relative to a longitudinally adjacent corner molding and a selected tier of building elements of a laterally adjacent wall panel, said mounting flanges extending from a pair of longitudinal flanges disposed in inwardly extending relation from an underside of the building elements, transverse flanges mounted adjacent opposite ends of said longitudinal flanges, and said interlock pin being mounted in outwardly extending relation to one of said transverse flanges and said interlock pin receiving aperture being formed in the other of said transverse flanges.

27. A corner molding for a wall covering mountable on two wall surfaces that form a corner and which includes a plurality of laterally adjacent wall panels each formed with a plurality of horizontal tiers of simulated building elements, said corner molding comprising a single tier of building elements having a pair of building elements disposed at an angle to each other corresponding substantially to the angle of the wall surfaces that define a corner upon which the corner molding is mountable, a pair of mounting flanges disposed at an angle to each other in underlying relation to the pair of simulated building elements for mounting on the wall surfaces, said mounting flanges each having a longitudinally extended portion at one end that extends beyond one longitudinal end of the simulated building elements of the corner molding, said extended portions of said mounting flanges being separated by a space that defines a breathing opening between the corner molding and the wall surfaces upon which the corner molding is mounted, said corner molding simulated building elements each having an extended portion that extends beyond an opposite longitudinal end of said mounting flanges, at least one interlock pin extending beyond one longitudinal end of the simulated building elements of the corner molding, and said corner molding being formed with an interlock pin receiving aperture for receiving the interlock pin of a longitudinally adjacent corner molding for permitting interlocking adjustable positioning of the corner molding on the wall surfaces relative to a longitudinally adjacent corner molding and a selected tier of building elements of a laterally adjacent wall panel.

* * * * *